US008282343B2

(12) United States Patent
Smith

(10) Patent No.: US 8,282,343 B2
(45) Date of Patent: Oct. 9, 2012

(54) VANE

(75) Inventor: Robert J. Smith, Cheltenham (GB)

(73) Assignee: Rolls-Royce PLC, London (GB)

( * ) Notice: Subject to any disclaimer, the term of this patent is extended or adjusted under 35 U.S.C. 154(b) by 601 days.

(21) Appl. No.: 12/461,539

(22) Filed: Aug. 14, 2009

(65) Prior Publication Data

US 2010/0135778 A1 Jun. 3, 2010

(30) Foreign Application Priority Data

Nov. 28, 2008 (GB) ..... 0821749.9

(51) Int. Cl.
*F01D 9/02* (2006.01)

(52) U.S. Cl. ..... 415/118; 415/201; 415/208.1; 416/61

(58) Field of Classification Search ..... 415/118, 415/201, 208.1; 416/61
See application file for complete search history.

(56) References Cited

U.S. PATENT DOCUMENTS

| | | | | |
|---|---|---|---|---|
| 3,362,160 | A * | 1/1968 | Bourgeois | 415/126 |
| 4,815,276 | A * | 3/1989 | Hansel et al. | 415/118 |
| 5,115,636 | A * | 5/1992 | Zeiser | 415/118 |
| 5,867,976 | A * | 2/1999 | Ziegler, Jr. | 415/118 |
| 6,468,033 | B1 * | 10/2002 | Weidlich | 415/118 |
| 6,938,522 | B1 | 9/2005 | Stannik | |

* cited by examiner

*Primary Examiner* — Igor Kershteyn
(74) *Attorney, Agent, or Firm* — Oliff & Berridge, PLC

(57) ABSTRACT

A vane for a gas turbine engine includes a cap arrangement having a cap insert and a cap adapted to receive the insert. The cap insert has a wall defining a through passage from top to bottom of the cap insert for receiving a cable or the like therethrough. The wall has a slot with a convoluted profile.

13 Claims, 5 Drawing Sheets

VANE

The present invention relates to a vane for a gas turbine engine comprising a cap arrangement comprising a cap insert and a cap adapted to receive the insert, the cap insert receives therethrough an electrical wire with one or more connectors at its end or ends.

One particular application of such a cap and cap insert is for a vane of a gas turbine engine, for example an inlet guide vane (IGV). Such vanes may comprise a heater mat lain on one surface of the vane. The heater mat is electrically operated and therefore requires one or more electrical wires to be connected to the mat, passed through the vane body and into other structures of the engine to be connected to an electrical supply and operating signal source. A lever arm is typically attached to the top of the vane and must be held in place by a cap insert, through which the electrical wires must pass.

This arrangement is shown in FIG. 1 and FIG. 2, in end cross-section and isometric views respectively, in which the vane 34 has a heater mat 36 attached to one surface and operated via electrical wires 38. The top spindle of the vane 34 is shaped as a cap 40 that is roughly annular and has a central bore 42 that is internally threaded. Mounted above the vane 34 is a lever arm 44 that comprises, at one end, a tubular portion that slots over the cap 40 of the vane 34. The lever 44, in use, actuates the change of angle of the IGV. In order to hold the lever arm 44 to the vane 34 a cap insert 46, called a lever clamping cap, is provided that is threaded to engage with the internal threading of the cap 40 to operatively lock the components together. The electrical wires 38 pass through the central bore 42 and terminate in connectors 48 for connection to other parts of the associated electrical circuit.

One disadvantage of this arrangement is that, as is most clearly shown in FIG. 2, the connectors 48 are limited in diameter to that which can pass through the aperture in the cap insert 46. This may lead to inefficiencies and increased weight and numbers of parts due to a requirement to use two or more smaller connectors rather than one larger one.

An improvement on this method provides a split vertically through the wall of the cap insert 46, as shown in FIG. 3. The periphery wall 50, that is externally threaded to engage with the internal threading of the cap 40, and the upper surface 52 are both annular but comprise a small gap that defines a slot 54. The slot 54 is sized to permit the electrical wires 38 to pass therethrough from the outside to the hollow centre of the cap insert 46. This allows the insert 46 to accommodate wires 38 with larger diameter connectors 48 than will pass through its central bore.

One disadvantage of this improved arrangement is that the wires 38 are prone to sliding back out through the slot 54. This can cause damage to the wires 38 and/or surrounding components. In particular, the wires 38 may become trapped between the periphery wall 50 of the insert 46 and the wall of the cap 40 where it will be damaged by the threads and may also damage the threads themselves.

The present invention seeks to provide a vane for a gas turbine engine comprising a cap arrangement that seeks to address the aforementioned problems.

Accordingly the present invention provides a vane for a gas turbine engine comprising a cap arrangement comprising a cap insert and a cap adapted to receive the insert, the cap insert comprising a wall defining a through passage from top to bottom of the cap insert for receiving a cable or the like therethrough, the wall comprising a slot with a convoluted profile. This is advantageous in that it permits a cable or the like to be inserted into the through passage transversely rather than being fed through from top to bottom.

The sides of the slot may be substantially parallel.

The slot may have a convoluted profile between the top and bottom of the wall. Alternatively or additionally, the slot may have a convoluted profile between the inner and outer sides of the wall.

The sides of the slot may include an offset portion that provides the convoluted profile. The offset portion may be at the top of the slot relative to the bottom of the slot. Alternatively a middle portion may be offset from the top and bottom of the slot.

The sides of the slot may be curved, at a constant or a non-constant angle.

The sides of the slot may comprise more than one portion, each portion being straight or angled and being angled or offset relative to at least one other portion.

The wall may define a substantially tubular shape. At least part of the wall may be threaded to facilitate connection to and engagement with another component. The outer or inner surface of the wall may be threaded. Alternatively the wall may be provided with another feature for connection to and engagement with another component, such as protrusions to facilitate a push-fit connection.

The vane may comprise an electrical wire received through the through passage, the electrical wire having a connector at one or both of its ends.

The present invention will be more fully described by way of example with reference to the accompanying drawings, in which.

Figure 4:
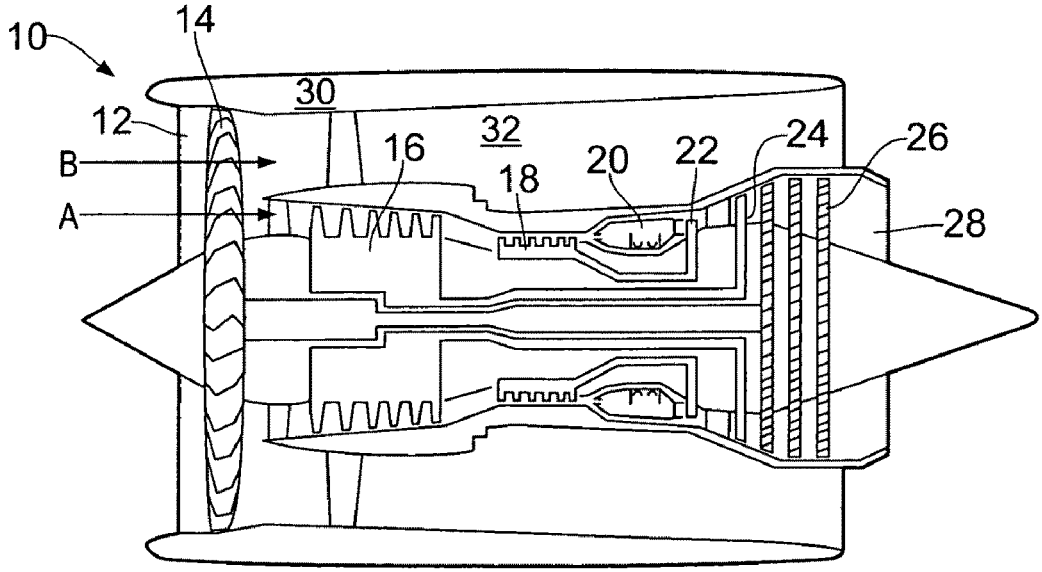
FIG. 4 is a sectional side view of a gas turbine engine.

A gas turbine engine 10 is shown in FIG. 4 and comprises an air intake 12 and a propulsive fan 14 that generates two airflows A and B. The gas turbine engine 10 comprises, in axial flow A, an intermediate pressure compressor 16, a high pressure compressor 18, a combustor 20, a high pressure turbine 22, an intermediate pressure turbine 24, a low pressure turbine 26 and an exhaust nozzle 28. Each stage of the compressors 16, 18 and turbines 22, 24, 26 comprises alternating rotating blade sets and sets of stationary vanes, such as vane 34. A nacelle 30 surrounds the gas turbine engine 10 and defines, in axial flow B, a bypass duct 32.

Figure 5:
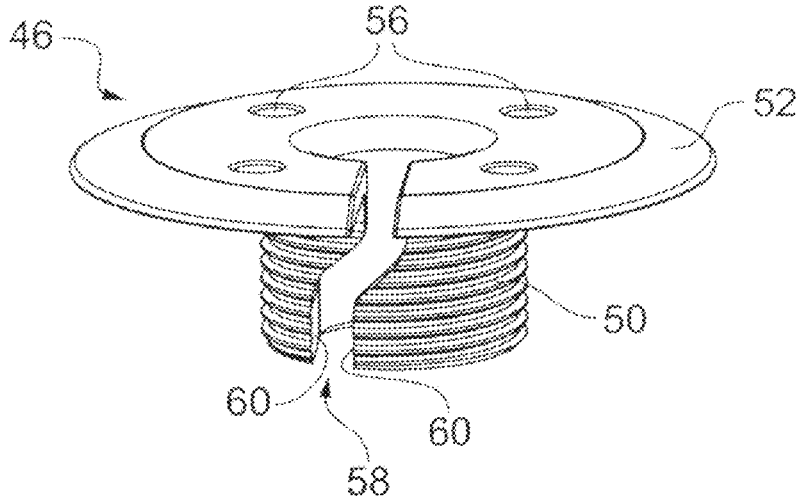
FIG. 5 is a perspective view of an insert according to the present invention.

An exemplary embodiment of the insert 46 of the present invention is shown in FIG. 5. The insert 46 is the same general shape as that of the prior art and therefore comprises a substantially annular periphery wall 50 that is externally threaded for engagement with the internal threading of the wall of the cap 40 at the top of the vane 34. Extending from the top of the periphery wall 50 is an upper surface 52 that is shaped to trap the lever arm 44 in position relative to the vane 34. The upper surface 52, as shown in FIG. 5, is substantially planar and tapers towards its radially outer extent. It comprises four apertures 56, or a different number of apertures, that receive therethrough fixing means for further fixing the insert 46 to the cap 40.

The periphery wall 50 defines a slot 58 between its ends 60. The ends 60 of the wall 50 forming the sides of the slot 58 are parallel to each other so that the slot 58 has a constant width.

Figure 1:
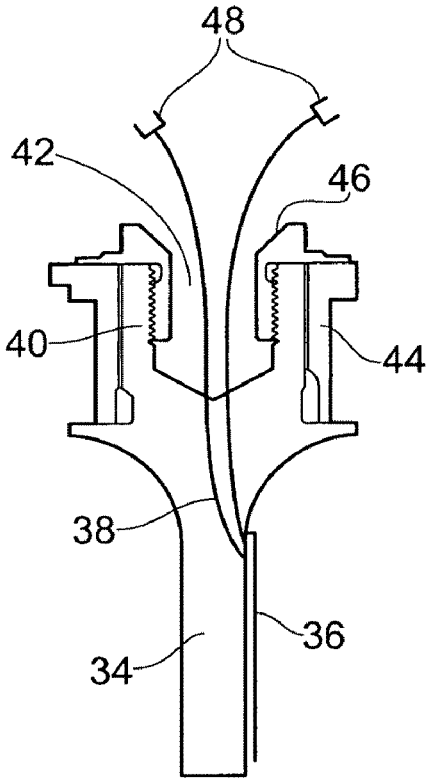
FIG. 1 (Prior Art)
FIG. 1 is a schematic cross-section of a vane cap and insert according to the prior art.
Figure 2:
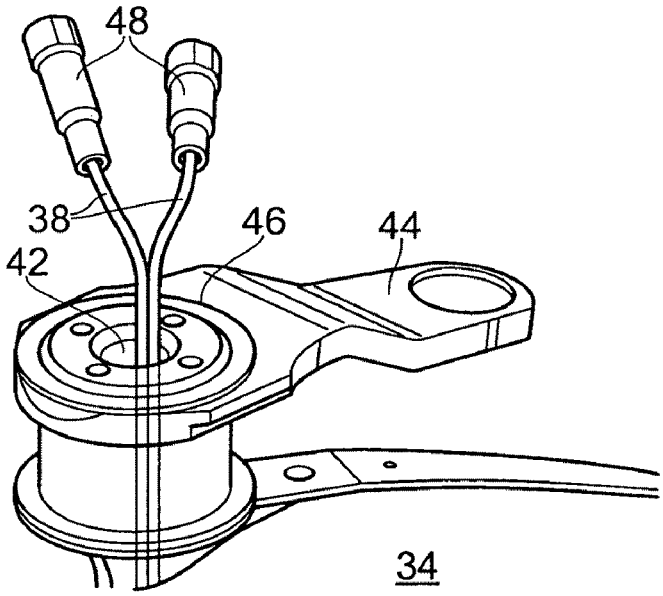
FIG. 2 (Prior Art)
FIG. 2 is an isometric view of the prior art arrangement of FIG. 1.
Figure 3:
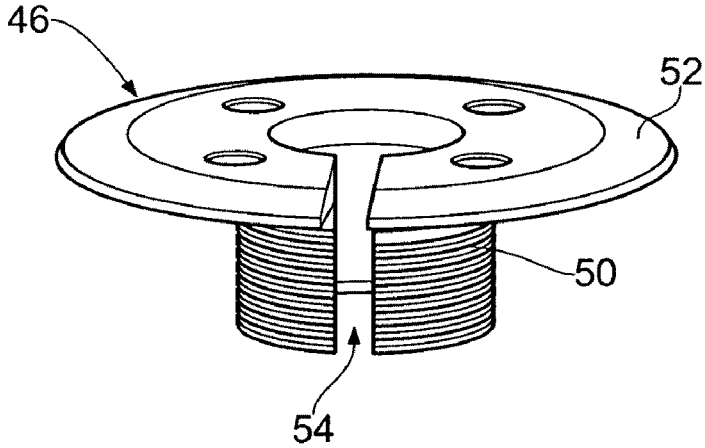
FIG. 3 (Prior Art)
FIG. 3 is a perspective view of a second prior art insert.

As in the prior art, the width of the slot 58 is such that the electrical wire 38 can be received therethrough to be inserted into the central bore of the insert 46 transversely. In contrast to the straight slot 54 in the insert 46 of the prior art, shown in FIG. 3, the slot 58 in the insert 46 of the present invention has a convoluted shape or profile. Thus the top of the slot 58, as defined by the top of the periphery wall 50 and the upper surface 52, is offset from the bottom of the slot 58. The slot 58 is formed of three portions, the upper and lower portions extending substantially vertically, as illustrated, and offset circumferentially from each other, and the middle portion being angled to connect the upper and lower portions so that the ends 60 of the wall 50 are continuous over their whole axial height.

The convoluted profile of the slot 58 of the present invention means that in order to push an electrical wire 38 into the hollow centre of the insert 46 it is first necessary to distort the shape of the wire 38 to complement that of the slot 58. When the wire 38 is bent to a matching shape it can be pushed through the slot 58 and into the hollow bore, where the wire 38 is allowed to regain its natural shape, typically substantially straight. Likewise, to remove the wire 38 from the bore it must first be bent to complement the shape of the slot 58 in order to be pushed out through the slot 58. This in turn means that it is unlikely that the wire 38 will be able to escape through the slot 58 by accident as it is unlikely that the wire 38 will bend to the right shape as well as experiencing sufficient radial force to push it through the slot 58. Thus the wire 38 is secured within the bore of the insert 46 and is protected from damage by contact with the mating threads of the insert 46 and cap 40 without the need for additional restraining means which themselves could chafe against the wire 38.

Figure 6:
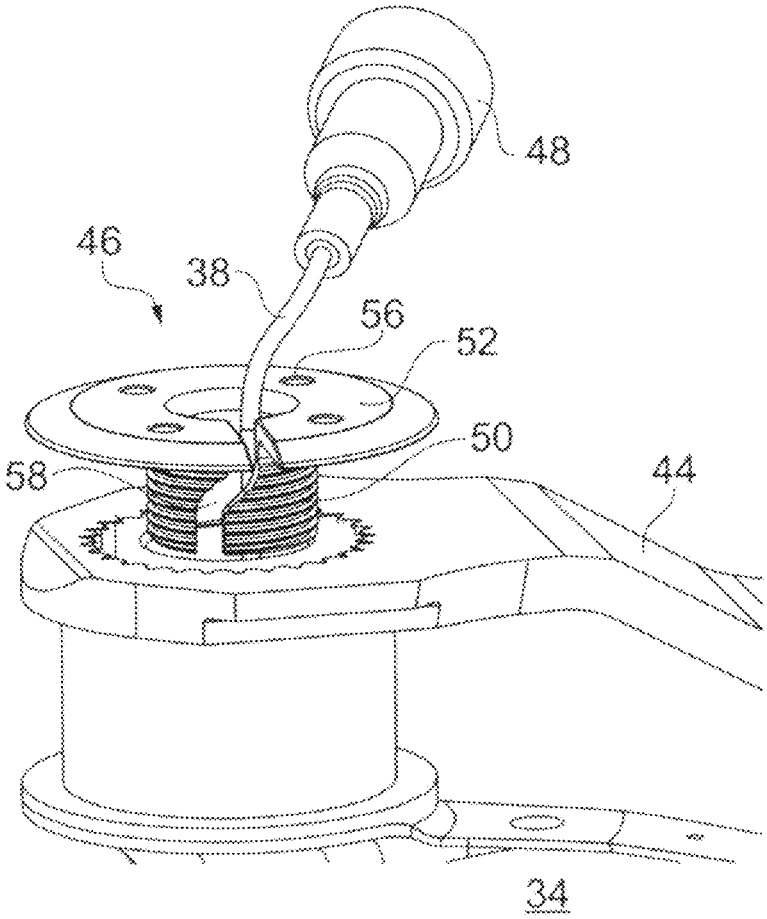
FIG. 6 is a perspective view of the insert and cap arrangement according to the present invention.

FIG. 6 shows the insert 46 prior to it being screwed into the cap 40 of the vane 34 to secure the lever arm 44 thereto. A wire 38 has been bent to match the shape of the slot 58 and pushed through the slot 58 where it is allowed to regain its natural straight shape. It is clear that the connector 48 on the end of the wire 38 has a much larger diameter than the bore of the insert 46. It is also apparent that only one wire 38 with a large connector 48 is required in this case, instead of the multiple wires 38 with small connectors 48 required by the prior art arrangements.

FIG. 7 to FIG. 11 show the slot 58 defined by the ends 60 of the wall 50 in side view, whereby the upper surface 52 (not shown) is at the top of the drawing, or alternatively show the slot 58 in plan view so that the top of the drawing is the inner surface of the wall 50 and the bottom of the drawing is the external, threaded surface of the wall 50. Typically the wall 50 is relatively thin and so the slot 58 has less radial extent than axial extent. The figures are not to scale.

Figure 7:
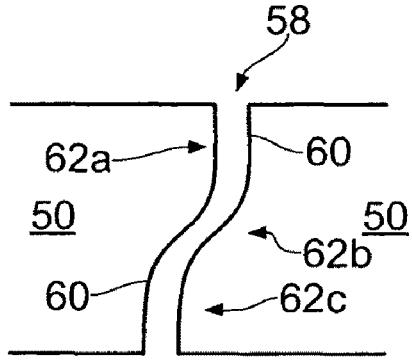
FIG. 7 to FIG. 11 show alternative embodiments of the slot in the insert according to the present invention.

When considered in side view, FIG. 7 shows the slot 58 as described and illustrated in FIG. 5 and FIG. 6. When considered in plan view, it shows the slot 58 having an offset between the outer (external) and inner surfaces of the periphery wall 50. The slot 58 is composed of three portions 62*a*, 62*b*, 62*c*. The first portion 62*a* extends from the inner surface of the periphery wall 50 and is substantially radial. Similarly, the third portion 62*c* extends from the external threaded surface of the periphery wall 50 and is also substantially radial. The third portion 62*c* is offset circumferentially from the first portion 62*a*. Between these two portions 62*a*, 62*c* and extending at an angle is the second, middle portion 62*b*. The ends of adjacent portions 62*a*, 62*b*, 62*c* are arranged to be contiguous so that the ends 60 of the wall 50 are smooth and continuous across their whole extent. It will be understood that to push the wire 38 through the radially offset slot 58 herein described the wire 38 may be held straight but will need to be translated circumferentially at the appropriate moments as it is pushed radially into the insert 46 so that it follows the convoluted slot path defined by the ends 60 of the wall 50.

Each of FIG. 8 to FIG. 11 will be described in side view but it should be understood that each embodiment is applicable, mutatis mutandis, in plan view also.

Figure 8:
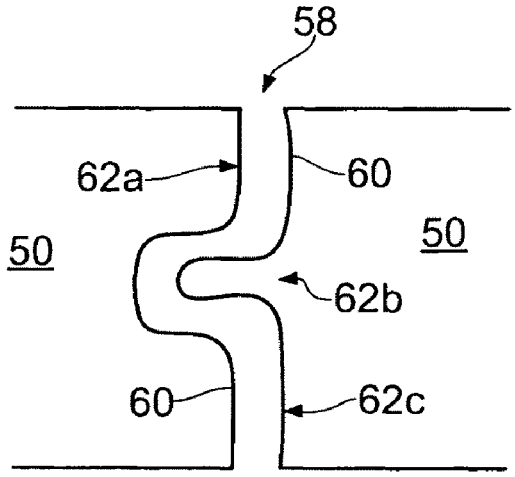

FIG. 8 shows a slot 58 profile having three portions 62*a*, 62*b*, 62*c*. The first and third portions 62*a*, 62*c*, extending axially from the top and bottom of the wall 50 respectively, are substantially parallel and circumferentially aligned to each other. The middle, second portion 62*b* is substantially C-shaped. This is a more complex convoluted shape than that depicted in FIG. 7 which is beneficial because it makes it more difficult for the wire 38 to accidentally escape the bore of the insert 46. However, this embodiment of the slot 58 is restricted to use with relatively flexible wires 38 as stiff wires 38 may not bend sufficiently to negotiate the tortuous path defined by this shape of slot 58.

Figure 9:
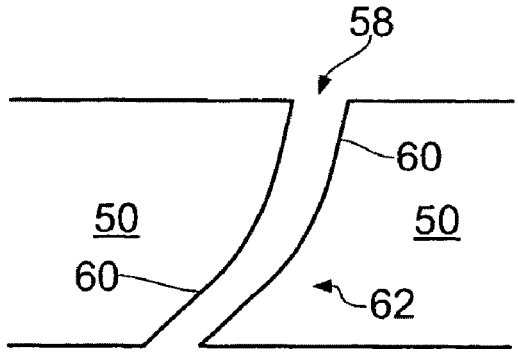

FIG. 9 shows an alternative embodiment wherein there is only one portion 62. The ends 60 of the periphery wall 50 are curved so that the top and bottom of the slot 58 are relatively offset circumferentially. The angle of the curve may be greater or smaller depending on how flexible the wire 38 is and how strongly it regains a straight shape. If the wire 38 is prone to retaining some of the bend imparted to it, the slot 58 needs to curve on a tighter radius so that the wire 38 cannot escape through the slot 58 accidentally. The ends 60 forming the sides of the slot 58 may curve at a constant or a varying rate.

Figure 10:
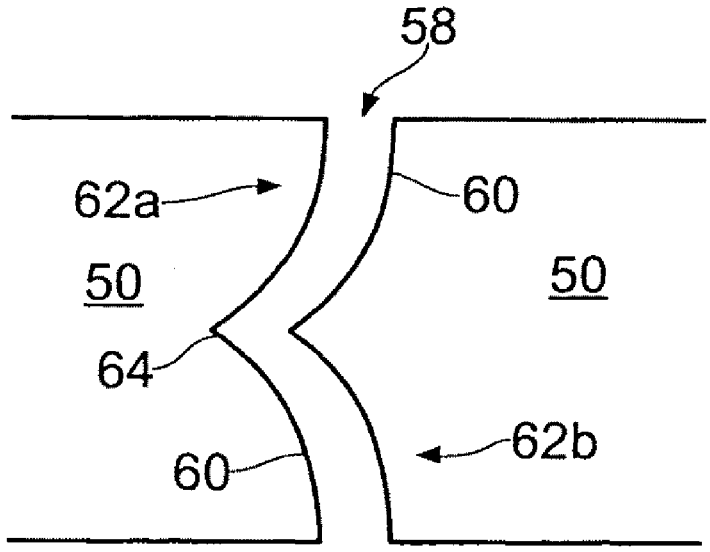

FIG. 10 is a refinement of the embodiment in FIG. 9, in which there are two portions 62*a*, 62*b* both of which curve at a different angle. As illustrated one portion 62*a* defines a concave curve while the other section 62*b* defines a convex curve. However, both curves may be convex or concave. There is a sharp switch-back 64 where the two portions 62*a*, 62*b* meet at which there is an abrupt change in angle. As in the embodiment depicted in FIG. 8 this profile is only feasible for use with relatively flexible wires 38. The design of this embodiment of the slot 58 may be modified within the scope of the invention so that the discontinuity at the join between the two portions 62*a*, 62*b* is smoother.

Figure 11:
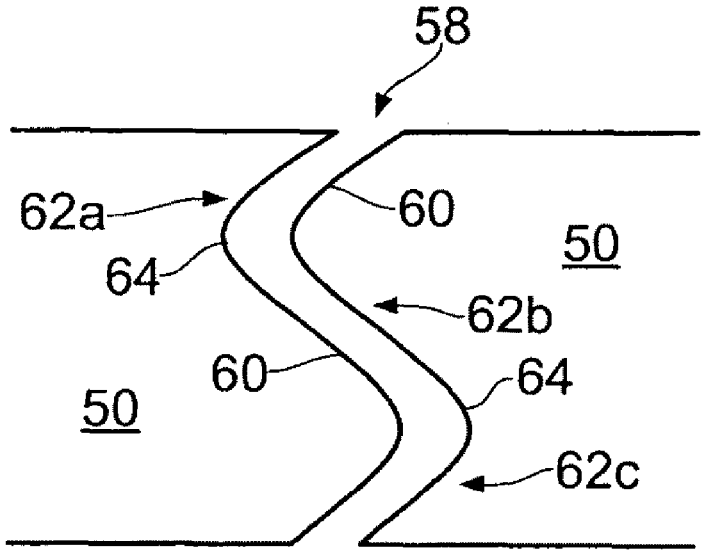

A further refinement of the embodiment in FIG. 9 is the S-shaped slot 58 in FIG. 11. This comprises three portions 62*a*, 62*b*, 62*c*, all of which are angled across the axial direction. The first and third portions 62*a*, 62*c* may be substantially parallel or may be at different angles. The middle portion 62*b* is angled in the opposite direction and is joined to the first and third portions 62*a*, 62*c* respectively by curved switch-back portions 64. Although two curved switch-backs 64 are shown, the slot 58 could be extended by adding further curved switch-backs 64 between additional angled portions 62 of the slot 58, defined by the ends 60 of the wall 50.

Although particular embodiments of the present invention have been described herein, it will be understood that many modifications and variations may be made to the insert 46 of the present invention without departing from the scope of the invention.

For example, other slot profiles may be substituted with equal felicity. Any of the profiles in side view discussed for the slot 58 may be combined with any of the profiles in plan view. This creates a slot 58 that is convoluted in two directions simultaneously. Although this increases the complexity of bending and movement required to push the electrical wires 38 through the slot 58, it reduces the likelihood of the wires 38 bending accidentally to a shape whereby they can escape from the centre of the insert 46 and become damaged by contact with the insert 46 and/or the cap 40 and surrounding components.

Although the slot 58 has been described having parallel sides formed by the ends 60 of the periphery wall 50, the slot 58 may alternatively have non-parallel sides. For example a middle portion of the slot 58 may be wider to accommodate a larger part of a wire or cable being used with the cap insert 46 of the present invention. The wire or cable may have a bulbous portion where two sections are spliced together, either at a planned join or due to repairs, or where a bundle of wires are held together, for example using a clip or heat shrink wrapping.

The cap insert 46 need not have the upper surface 52. Instead it may comprise a substantially cylindrical hollow plug, threaded or not as required by the application. The periphery wall 50 may define a cylindrical shape or may form a square cross-section tube or have a different cross-sectional shape, which need not be regular in all applications. Clearly where the insert 46 is intended to be screwed into another component, such as a cap 40, it is necessary for it to have a threaded cylindrical portion. Alternatively the insert 46 may have a push-fit connection with another component, such as cap 40.

In preferred embodiments of the insert 46 the wall 50 is parallel across the diameter of the insert 46. However, the insert 46 does not need to have a constant diameter between its top and bottom edges. Instead, and where connection to another component is via a push-fit or other non-screwed arrangement, the insert 46 may taper between top and bottom or may have a changing diameter.

Although the slot profile of the present invention has been described in relation to a cap insert 46 for the cap 40 of a vane 34, it may equally be applied to other applications. For example, any wire clipping harnesses, such as used on gas turbine engines and elsewhere, could be adapted by the addition of a convoluted slot 58 so that wires 38 can be used therewith that have larger connectors 48. Equally, pipes or optical fibres may be substituted for the wires 38.

The slot profile of the present invention can be applied in other fields such as telecommunications, electronics, transport and automotive, oil and gas industries. For example, the slot profile could be applied to telephone trunking installed in buildings. This is square-section trunking that could have the slot provided in an upper surface so that telephone wires could be slotted into the trunking rather than being pushed through from one end and potentially getting tangled or blocked part of the way along the trunk.

The invention claimed is:

1. A vane for a gas turbine engine comprising:

a cap arrangement including:

a cap insert; and a cap adapted to receive the insert, the cap insert having a wall defining a through passage from a top to a bottom of the cap insert for receiving a cable therethrough, and the wall defining a slot with a convoluted profile.

2. The vane of claim 1 wherein sides of the slot are substantially parallel.

3. The vane of claim 1 wherein the slot has the convoluted profile between a top and a bottom of the wall.

4. The vane of claim 1 wherein the slot has the convoluted profile between inner and outer sides of the wall.

5. The vane of claim 1 wherein the slot has sides that include an offset portion.

6. The vane of claim 5 wherein the offset portion is at a top of the slot relative to a bottom of the slot.

7. The vane of claim 1 wherein the slot has sides that are curved.

8. The vane of claim 7 wherein the sides of the slot are curved at a constant angle.

9. The vane of claim 7 wherein the sides of the slot are curved at a non-constant angle.

10. The vane of claim 1 wherein the slot has sides that comprise more than one portion, each portion being straight or curved and being angled or offset relative to at least one other portion.

11. The vane of claim 1 wherein the wall defines a substantially tubular shape.

12. The vane of claim 1 wherein at least part of the wall is threaded to facilitate connection to and engagement with the cap.

13. The vane of claim 1 comprising an electrical wire received through the through passage, the electrical wire having a connector at one or both of its ends.

* * * * *